US011506106B2

(12) United States Patent
Bundy et al.

(10) Patent No.: US 11,506,106 B2
(45) Date of Patent: Nov. 22, 2022

(54) EXHAUST AFTERTREATMENT SYSTEM UNIVERSAL JOINT FLEX PIPE ASSEMBLY

(71) Applicant: PACCAR Inc, Bellevue, WA (US)

(72) Inventors: Robert Lee Bundy, Anacortes, WA (US); James Noah Park, Burlington, WA (US)

(73) Assignee: PACCAR Inc, Bellevue, WA (US)

( * ) Notice: Subject to any disclaimer, the term of this patent is extended or adjusted under 35 U.S.C. 154(b) by 373 days.

(21) Appl. No.: 16/790,528

(22) Filed: Feb. 13, 2020

(65) Prior Publication Data

US 2021/0254537 A1 Aug. 19, 2021

(51) Int. Cl.
*F01N 13/08* (2010.01)
*F01N 13/18* (2010.01)

(52) U.S. Cl.
CPC ..... *F01N 13/1816* (2013.01); *F01N 13/1822* (2013.01); *F01N 13/1855* (2013.01)

(58) Field of Classification Search
CPC ..... F01N 13/1816; F01N 13/1844; F01N 13/1855; F16L 27/111; F16L 27/113
See application file for complete search history.

(56) References Cited

U.S. PATENT DOCUMENTS

| | | | | |
|---|---|---|---|---|
| 4,819,965 | A * | 4/1989 | Press | F16L 27/111 285/55 |
| 5,839,473 | A * | 11/1998 | Caine | F01N 13/082 181/263 |
| 7,506,667 | B1 | 3/2009 | Johnson et al. | |
| 9,719,680 | B2 * | 8/2017 | Staller | F23J 11/08 |
| 2016/0033066 | A1 * | 2/2016 | Patriarca | F16L 25/065 29/434 |
| 2020/0200294 | A1 * | 6/2020 | Di Carlo | F16L 5/022 |

FOREIGN PATENT DOCUMENTS

| | | | | |
|---|---|---|---|---|
| DE | 28 45 134 | A1 | 11/1979 | |
| DE | 19548719 | C1 * | 4/1997 | F01N 13/1811 |
| IT | MC20120081 | A1 | 4/2014 | |

* cited by examiner

*Primary Examiner* — Jonathan R Matthias
(74) *Attorney, Agent, or Firm* — Seed IP Law Group LLP

(57) ABSTRACT

The present disclosure is directed to a flexible pipe assembly that includes a pipe, a sleeve, a first connection assembly, and a second connection assembly. The pipe of the flexible pipe assembly includes a first end portion that is coupled to an external vertical exhaust pipe that allows exhaust to escape from a truck and a second end portion that is coupled to a pipe to an outlet of an exhaust aftertreatment system (EAS). The pipe also includes a third portion, which is a bellows, coupling the first end portion to the second end portion of the pipe of the flexible pipe assembly. The first and second connection assemblies couple the sleeve to the pipe of the flexible pipe assembly by passing through holes in the sleeve and the pipe of the flexible pipe assembly.

20 Claims, 9 Drawing Sheets

EXHAUST AFTERTREATMENT SYSTEM UNIVERSAL JOINT FLEX PIPE ASSEMBLY

BACKGROUND

Technical Field

The present disclosure relates to a pipe assembly coupling an exhaust aftertreatment system (EAS) that is coupled to an exhaust outlet of an engine of a vehicle to an exhaust pipe of the vehicle.

Description of the Related Art

As requirements and demands to reduce emissions of vehicles and trucks within the vehicle and truck industries increases and use of EAS becomes more common, manufacturers face significant challenges to provide exhaust systems that can resist and withstand vibrational stresses such as resonance frequencies or a natural frequencies of various components that the various components are exposed to when a vehicle or truck is in use. This is especially true when the EAS is secured and mounted to a vehicle chassis and an exhaust pipe is secured and mounted to the EAS and is secured and mounted to a cab of the vehicle because the vehicle chassis and cab move relative to each other, which causes vibrational stresses that may be close to natural frequencies of various components within the vehicle or truck. The cab may be mounted to the vehicle chassis utilizing a cab suspension system, which may be an air spring or a rubber mounting, that allows movement between the cab and the chassis.

For example, an exhaust pipe, which provides an outlet for exhaust to escape from an exhaust after treatment system, may be loosely coupled to a cab of a truck and rigidly coupled to an outlet of the exhaust after treatment system. The exhaust pipe may be a single, unitary pipe with bends to be coupled to an outlet of the exhaust aftertreatment system (EAS). These bends in the exhaust pipe and coupling between the exhaust pipe and the outlet are points at which failure is likely to occur when the truck is being driven because of external stresses caused by vibration, external forces, or relative movement between the chassis and cab when the vehicle or truck is in use. Other points of failure include points where the exhaust pipe is mounted to the cab and points where the EAS is mounted to the vehicle chassis.

Generally, manufacturers try to determine and find ways to rigidly connect an exhaust pipe to an outlet of an EAS to improve resistance of the connection against vibrational stresses by reducing the likelihood that the exhaust pipe will vibrate at a mode of resonant or natural frequency. In addition, manufacturers try to determine and find ways to allow bending, deformation, or movement in the connection within or to a vehicle or truck to improve resistance of the connection against relative movement between the chassis and cab of a truck when the truck is in use. However, if the exhaust pipe is mounted too loosely or provided too many degrees of freedom, the harmfulness of certain stresses and relative movements can increase substantially if low stiffness of the exhaust pipe results in excessive movement or resonance when the exhaust pipe is exposed to the operating environment of the vehicle. Likewise, if the exhaust pipe is mounted too rigidly, the harmfulness of relative movements between the chassis and cab of the truck increases substantially. Accordingly, it is a significant challenge to provide an exhaust system having a low stiffness in certain degrees of freedom, which allow for relative movement between connection points on the cab and the chassis, while maintaining a high stiffness in other degrees of freedom to prevent excessive movement or modal resonance with the vibrations present in the operating environment of the vehicle is desired.

BRIEF SUMMARY

In view of these significant challenges as set forth above, which is not a complete list, it is desirable to provide a flexible pipe assembly that can reduce the stresses in an exhaust pipe to avoid failure in the exhaust pipe due to external stresses.

The present disclosure is directed to a flexible pipe assembly, which may be referred to as a universal flex joint assembly. An embodiment of the flexible pipe assembly includes a pipe positioned within a sleeve, which is configured to protect the pipe from external debris and constrain degrees of freedom in the movement of the pipe, a first connection assembly, and a second connection assembly, which is generally similar to the first connection assembly.

The first connection assembly and the second connection assembly pass through respective holes in the sleeve and the pipe. The pipe has a first pair of holes and a second pair of holes. The sleeve has a third pair of holes aligned with the first pair of holes of the pipe and a fourth pair of holes aligned with the second pair of holes of the pipe. The first connection assembly and the second connection assembly couple the sleeve to the pipe and constrain the degrees of freedom in the movement of the pipe. The degrees of freedom include a radial degree of freedom, an axial degree of freedom, and a torsional degree of freedom.

When in use, the flexible pipe assembly is positioned between an exhaust pipe, which is configured to allow exhaust to leave the truck, and an outlet of an EAS or another pipe that is coupled to the outlet of the EAS of the truck. In some embodiments, the exhaust pipe is a vertical exhaust pipe that is mounted to a cab of a truck and the other pipe coupled to the outlet of the EAS may be a pipe with a bend such as an S-bend that extends between the outlet of the EAS to the flexible pipe assembly.

In certain embodiments, the pipe of the flexible pipe assembly that is positioned within the sleeve of the flexible pipe assembly may include a first end portion, a second end portion, and a bellows. The bellows is configured to allow flexing, bending, and deformation in the pipe to increase resistance against failure in the exhaust pipe system due to relative movement between a chassis and a cab of the truck when in use. The bellows may be a torsional bellows, a wrapped spiral bellows, a mesh bellows, a traditional bellows, an accordion bellows, a straight bellows, or any other bellows as desired that is configured to allow the flexible pipe assembly to flex, bend, or be displaced in a manner to allow the exhaust pipe and flexible pipe assembly to adjust, flex, bend, and deform in response to the relative movement between the chassis and the cab of the truck when in use, which increases the useful lifespan of the exhaust pipe and exhaust system.

BRIEF DESCRIPTION OF THE SEVERAL VIEWS OF THE DRAWINGS

In the drawings, identical reference numbers identify similar elements or acts unless context indicates otherwise. The sizes and relative portion of the elements in the drawings are not necessarily drawn to scale.

FIG. 4A is a first side view of the embodiment of the sleeve as disclosed in

FIG. 2;

FIG. 4B is a second side view of the embodiment of the sleeve as disclosed in

FIG. 2;

DETAILED DESCRIPTION

In the following description, certain specific details are set forth in order to provide a thorough understanding of various embodiments of the disclosure. However, one skilled in the art will understand that the disclosure may be practiced without these specific details.

Unless the context requires otherwise, throughout the specification and claims that follow, the word "comprise" and variations thereof, such as "comprises" and "comprising," are to be construed in an open, inclusive sense, that is, as "including, but not limited to."

The use of ordinals such as first, second and third does not necessarily imply a ranked sense of order, but rather may only distinguish between multiple instances of an act or structure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1A:
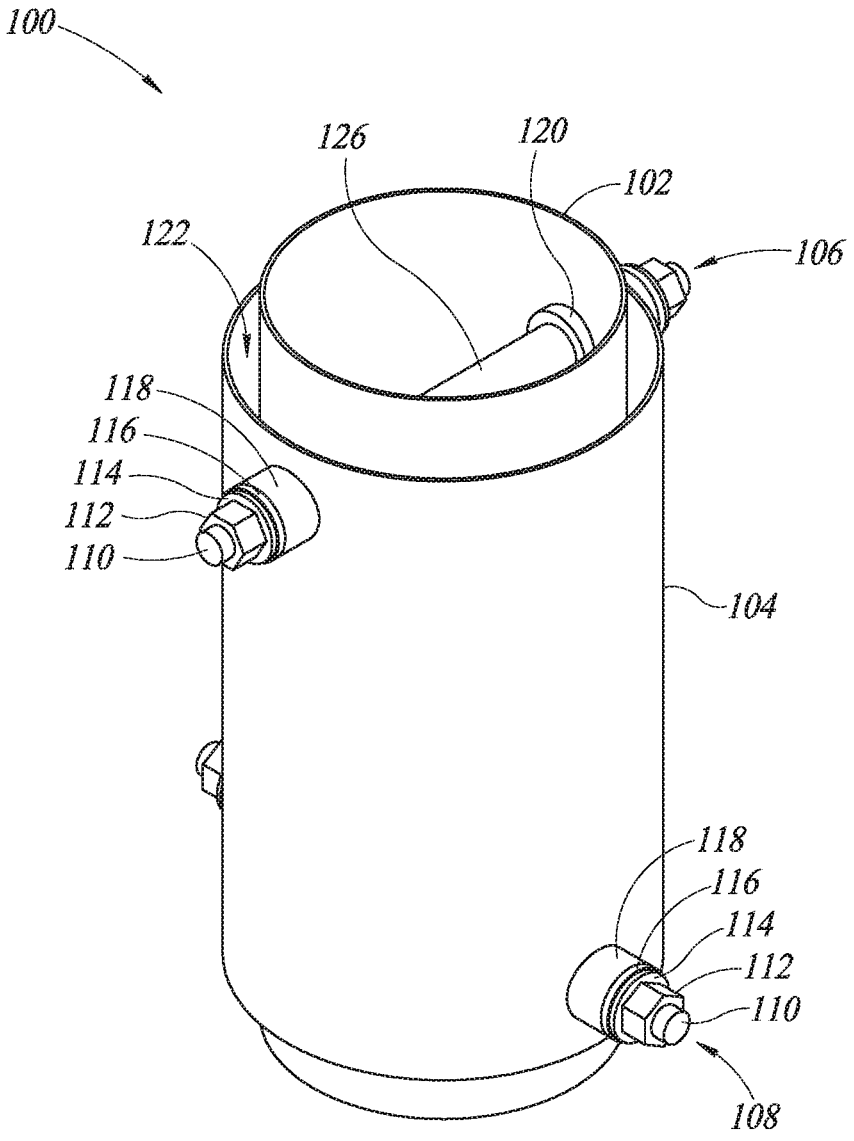
FIG. 1A is a perspective view of an embodiment of a flexible pipe assembly.

FIG. 1A illustrates a perspective view of a flexible pipe assembly 100 of the present disclosure. The flexible pipe assembly 100 includes a pipe 102 that is positioned within a sleeve 104 and the sleeve 104 surrounds the pipe 102 to protect the pipe from debris and to control degrees of freedom of the pipe 102. The degrees of freedom of the pipe 102 that the sleeve 104 helps constrain include a radial degree of freedom, a torsional degree of freedom, and an axial degree of freedom. The pipe 102 is coupled to an exhaust pipe 216 of an engine 300 with an exhaust aftertreatment system (EAS) 210, which will be discussed in greater detail with respect to FIG. 6. The sleeve 104 has a first radius and the pipe 102 has a second radius, the first radius of the sleeve 104 is greater than the second radius of the pipe 102. The difference in the first radius of the sleeve 104 and the second radius of the pipe 102 results in the pipe 102 being spaced from the sleeve 104 by a space 122. The width of the space 122 is equal to the difference in the first radius of the sleeve 104 and the second radius of the pipe 102. The space 122 allows for a bellows 134 of the inner pipe 102 to bend, to flex, or to deform in a manner such that the bellows 134 bends, flexes, or deforms in a radial direction. The radial direction is a direction that is perpendicular to a longitudinal axis of a center axis of the sleeve 104 and the pipe 102. As a width of the space 122 between the inner pipe 102 and the sleeve 104 is increased, the bellows 134 of the pipe may bend, flex, or deform by greater amounts. Conversely as the width of the space 122 between the inner pipe 102 and the sleeve 104 is decreased, the bellows 134 of the pipe may bend, flex, or deform by lesser amounts.

The first and second connection assemblies 106, 108 extend between, pass through, and couple the sleeve 104 to the pipe 102. These first and second connection assemblies 106, 108 keep the sleeve 104 fixed to the pipe 102 to constrain the radial degree of freedom of first end portion 130 and the second end portion 132 of the pipe 102 relative to the sleeve 104 in the radial direction, which will be discussed in greater detail later. The first and second connection assemblies 106, 108 may be referred to as trunnion cross shafts.

In addition to constraining the radial degree of freedom of the pipe 102 corresponding to radial movement of the pipe 102 in the radial direction, the first and second connection assemblies 106, 108 and the sleeve 104 work together to constrain the torsional degree of freedom corresponding to torsional movement of the pipe 102 in a torsional direction and the axial degree of freedom of the pipe 102 corresponding to axial movement of the pipe 102 in an axial direction as well. The torsional direction is a direction the pipe 102 twists around a rotational axis that is substantially parallel with the longitudinal axis or center line of the sleeve 104. The axial direction is a direction substantially parallel with the longitudinal axis or centerline of the sleeve 104. The term "substantially" means that there may be slight variation as to the exactness of the rotational axis being parallel with the longitudinal axis or center line of the sleeve 104. For example, the rotational axis and the longitudinal axis or center line of the sleeve 104 may not be perfectly aligned. This use of the term "substantially" will also apply to other similar uses of the term "substantially" in the present disclosure.

The first and second connection assemblies 106, 108 constrains, holds, or fixes the pipe 102 in place such that the pipe 102 cannot twist or rotate torsionally about the rotational axis that is parallel with the center axis of the pipe 102. For example, the torsional degree of freedom which corresponds to torsional movement of the pipe 102 in the torsional direction is constrained by the first and second connection assemblies 106, 108 because the first connection assembly 106 and the second connection assembly 108 pass through holes 136, 138, 140, 142 in the pipe 102 and holes 144, 146, 148, 150 in the sleeve 104, and the first connection assembly 106 and the second connection assembly 108 are transverse to one another. In the illustrated embodiment of the flexible pipe assembly in FIG. 1A, the first connection assembly 106 is perpendicular to the second connection assembly 108. In alternative embodiments, the first connection assembly 106 may be transverse to the second connection assembly 108 by 10 degrees, by 30 degrees, by 45 degrees, by 60 degrees, or by any other angle as desired. In another alternative embodiment, the first connection assembly 106 and the second connection assembly 108 may be parallel to one another.

As well as constraining the torsional and radial degrees of freedom of the pipe 102 as discussed earlier, the first and second connection assemblies 106, 108 and the sleeve 104 constrain, hold, or fix the axial degree of freedom of the pipe 102 in the axial direction. The axial degree of freedom corresponds to axial movement of the pipe 102 in the axial direction parallel to the central axis of the center of the pipe 102.

The first and second connection assemblies 106, 108 and the sleeve 104 constrain the axial degree of freedom of the pipe 102 because, as the pipe 102 attempts to move axially in reaction to external exerted forces, relative movements, or vibrations, the first and second connection assemblies 106, 108, which pass through the holes 136, 138, 140, 142 in the pipe 102 and the holes 144, 146, 148, 150 in the sleeve 104, stop, constrain, and/or limit the axial movement of the pipe 102. This above discussion also applies to the torsional degree of freedom and the radial degree of freedom respectively as well.

The first and second connection assemblies 106, 108 and the sleeve 104 constrain the radial degree of freedom of the pipe 102. The radial degree of freedom corresponds to radial movement of the pipe 102 in the radial direction of the radius of the pipe 102 and the sleeve 104. In this embodiment, the first and second flexible connections 106, 108 constrain or limit radial translation movement of the first and second end portions 130, 132 of the pipe 102 in the radial direction relative to the sleeve 104. The sleeve 104 is held in place by the first and second connection assemblies 106, 108. This causes the sleeve 104 to form a boundary around the pipe 102. The boundary of the sleeve 104 acts to constrain the radial degree of freedom of the pipe 102 because the sleeve 104 holds the first and second connection assemblies 106, 108 in place relative to the pipe 102.

The radial movement, the torsional movement, and the axial movement are movements that would result in the pipe 102 moving if vibrations, external forces, or a relative movements were applied to the pipe 102 and would cause the pipe 102 to move in the axial direction, the torsional direction, the radial direction, or a combination of these directions in the absence of any constraint, in accordance with embodiments of the present disclosure.

The radial degree of freedom, the torsional degree of freedom, and the axial degree of freedom may correspond to movements of the pipe 102 caused by relative movement between the chassis and the cab of the truck when a truck is in use. These relative movements may be a result of movement between the cab of the truck and a chassis of the truck, the acceleration loads when the truck is in use, road harmonics when the truck is being driven, or other external factors when the truck is in use.

Factors that cause vibration in the truck and the chassis of the truck when the truck is in use, which then create vibrational stresses in the various components of the truck, include the randomness of the road surface, road harmonics, tire/wheel vibration, engine vibration, chassis rigid-body modes, chassis structural modes, or other external factors when the truck is in use. For example, the typical ranges of vibration caused from randomness of a roads surface is 0-15 Hz, from road harmonics is 5-20 Hz, from tire/wheel vibration is 8-14 Hz, from engine first order is 10-30 Hz, from engine firing third order is 30-100 Hz, from chassis rigid-body modes is 0-15 Hz, and from chassis structural modes is 5-25 Hz. In accordance with embodiments of the present disclosure a first natural structural frequency mode of 20 Hz or greater for chassis mounted systems is targeted because components with a first natural structural frequency mode below 17 Hz tend to have a short useful life and may require replacement due to failure caused by vibrational stresses in that chassis mounted system.

In accordance with the embodiments of the present disclosure, the bellows 134 of the pipe 102 and the space 122 allow the pipe 102 to deform in response to relative movement between the chassis and the cab due to external factors when the truck is in use. The bending, flexing, or deforming of the bellows 134 in the pipe 102 will be discussed in greater detail later within the present disclosure.

In accordance with the embodiments of the present disclosure, the ends of the pipe 102 are fixed in place by the first and the second connection assemblies 106, 108. The first and second end portions 130, 132 of the pipe 102 being rigidly coupled to the sleeve 104 by the first and second connection assemblies 106 results in an increase in the first natural structural frequency mode of the pipe 102 because increasing a stiffness and a rigidity of the pipe 102 utilizing the first and second connection assemblies 106, 108, which may function as trunnions, increases modes of natural structural frequencies of the pipe 102. This means that by rigidly supporting the first and second end portions 130, 132 of the pipe 102, which increases the overall and relative stiffness and rigidity of the pipe 102, the first natural structural frequency mode of the pipe 102 increases as well. The increase in stiffness and rigidity due to fixing the ends of the pipe 102 will be discussed in greater detail later within the present disclosure.

Figure 1B:
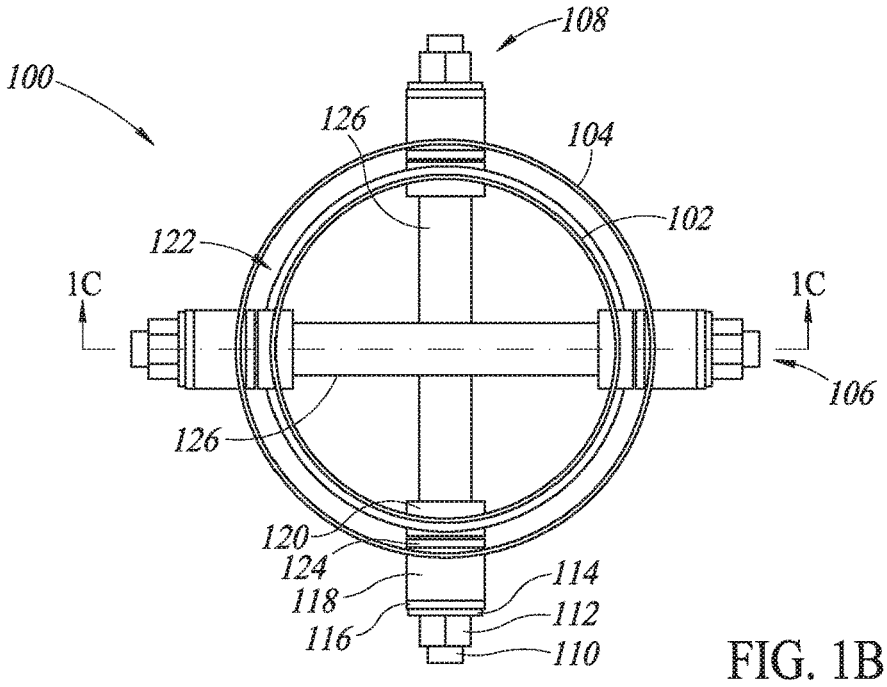
FIG. 1B is a top plan view of the embodiment of the flexible pipe assembly as disclosed in FIG. 1A.

FIG. 1B is a top plan view of the embodiment of the flexible pipe assembly 100 as discussed above with respect to FIG. 1A. As discussed above, in this embodiment of the flexible pipe assembly 100, the first and second connection assemblies 106, 108 are perpendicular to one another. However, as discussed above, the first and second connection assemblies 106, 108 may be transverse by any other angle as desired. In this top plan view, components of the first connection assembly 106 can be seen. However, for the sake of simplicity and brevity, the details of the components that make up the first connection assembly 106 and the second connection assembly 108 will be discussed in greater detail with respect to FIGS. 5A-5C.

Figure 1C:
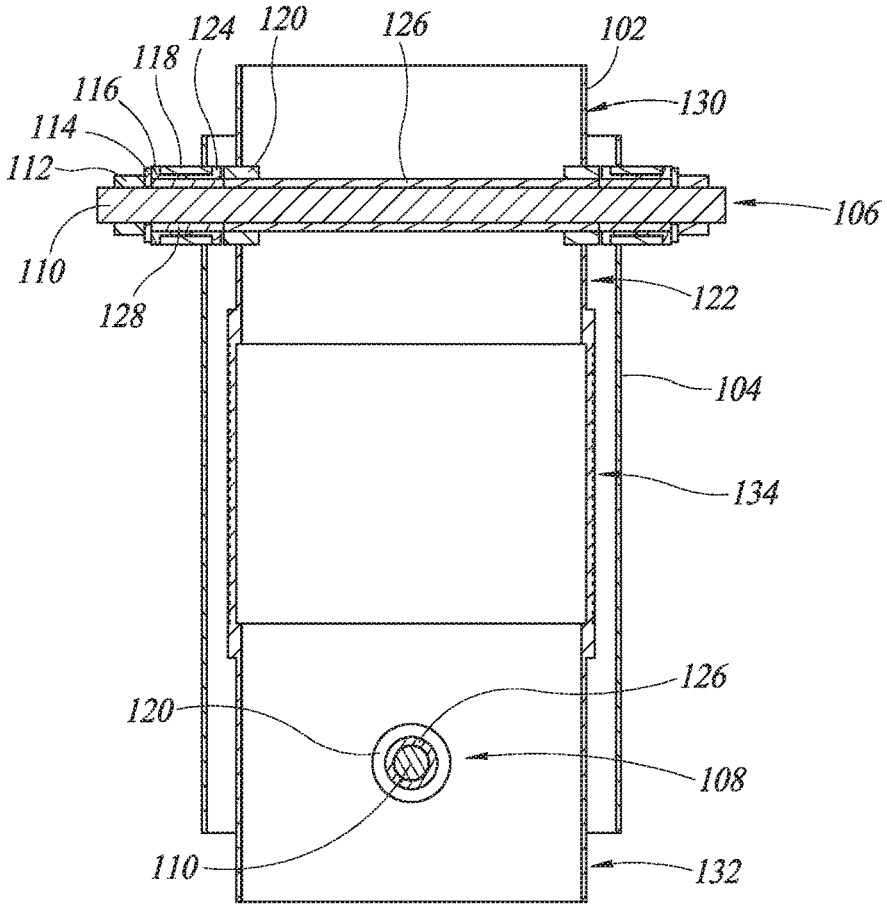
FIG. 1C is a cross-sectional view of the embodiment of the flexible pipe assembly taken along line 1C-1C as disclosed in FIG. 1B.

FIG. 1C is directed to a cross-sectional view of the flexible pipe assembly 100 taken along line 1C-1C in FIG. 1B. The first and second connection assemblies 106, 108 are spaced from one another by a distance that is less than a first height of the sleeve 104. In addition, the distance is less than a second height of the pipe 102 and the first height of the sleeve 104. Also, in this embodiment of the flexible pipe assembly 100, the second height of the pipe 102 is greater than the first height of the sleeve 104. In other alternative embodiments, the first height of the sleeve 104 may be greater than the second height of the pipe 102.

In this cross-sectional view, components of the first connection assembly 106 can be seen. However, again, for the sake of simplicity and brevity, the details of the components that make up the first connection assembly 106 and the second connection assembly 108 will be discussed in greater detail with respect to FIGS. 5A-5C.

The pipe 102 includes a plurality of holes 136, 138, 140, 142. A plurality of first pipe portions 120 are coupled to the pipe 102 at the plurality of holes 136, 138, 140, 142. A plurality of rods 126 are coupled to the plurality of first pipe portions 120. Each end of a respective first pipe portion 120 of the plurality of first pipe portions 120 is coupled to the pipe 102, by either being positioned in a respective hole of the plurality of holes 136, 138, 140, 142 or being coupled to the pipe in a way that aligns the bore in first pipe portions 120 with a hole 136, 138, 140 142 such that a rod can pass through pipe 102 and the associated hole 136, 138, 140 142. Each respective first pipe portion 120 is coupled to the pipe 102 by attaching, e.g., by welding, the first pipe portion 120 to the pipe 102. Each respective rod 126 of the plurality of rods 126 includes a hole that extends through the entire length of each rod 126. Each rod 126 extends between a respective pair of first pipe portions 120 and each end of the respective rods 126 is coupled to one of the pairs of respective first pipe portions 120. The ends of the respective rods 126 are coupled to the pairs of the respective first pipe portions 120 by positioning each rod within a pair of the respective first pipe portions 120 and then welding or otherwise attaching the end of the each rod 126 to the pair of respective first pipe portions 120. The rods 126 extend across the pipe from one hole in the pipe to another hole in the pipe. For the sake of simplicity and brevity, the details of how these components are used in combination with the first connection assembly 106 and the second connection assemblies 108 will be discussed in greater detail with respect to FIGS. 5A-5C.

In alternative embodiments, each respective first pipe portion 120 may be press fit into a corresponding respective hole 136, 138, 140, 142 of the pipe 102, and each respective rod 126 may be press fit into a pair of the respective holes 136, 138, 140, 142 of the pipe 102. In other alternative embodiments, the first pipe portions 120 may be coupled to the pipe 102 by welding techniques, by a combination of press fits and welding techniques, by an adhesive material, or by a combination of coupling techniques.

The sleeve 104 includes a plurality of pipe flanges 118 and a plurality of holes 144, 146, 148, 150. Each respective pipe flange 118 of the plurality of pipe flanges 118 is coupled to the sleeve 104 and is positioned in a respective hole of the plurality of holes 144, 146, 148, 150. Each respective pipe flange 118 is coupled to the sleeve 104 by welding the respective pipe flange 118 to the sleeve 104. For the sake of simplicity and brevity, the details of how these components are used in combination with the first connection assembly 106 and the second connection assemblies 108 will be discussed in greater detail with respect to FIGS. 5A-5C.

In alternative embodiments, each respective pipe flange 118 may be press fit into a corresponding respective hole 144, 146, 148, 150 of the sleeve. In other alternative embodiments, the pipe flanges 118 may be coupled to the sleeve by welding techniques, by a combination of press fits and welding techniques, by an adhesive material, or by a combination of coupling techniques.

In accordance with the embodiments of the present disclosure and with embodiments that are within the scope of the present disclosure, when the pipe 102 is exposed to a force, a vibration, or a relative movement that has a combination of various directional components or a single directional component of the radial direction, the axial direction, and the torsional direction, the bellows 134 of the pipe 102 bends, flexes, or deforms. For example, when the bellows 134 of the pipe 102 bends, flexes or deforms, the center line of the pipe 102, due to the bending, flexing, or deformation in the bellows 134, may be curved to have an S-shape, a C-shape, or combination of other types of shapes and bends. In other words, when the bellows 134 of the pipe 102 bends, flexes, or deforms, the center line of the pipe 102 is no longer coaxial with the center line of the outer sleeve 104 along its entire length. Conversely, when the bellows 134 of the pipe 102 does not bend, flex, or deform, the center line of the pipe 102 and the center line of the sleeve 104 are substantially coaxial with each other. The term "substantially" means that there may be slight variation as to the exactness of the centerline of the pipe 102 and the center line of the sleeve 104 having center lines that are substantially coaxial with each other. For example, the center line of the pipe 102 may not be perfectly coaxial with the center line of the sleeve 104. The use of the term "substantially" will also apply to other similar uses of the term "substantially" in the present disclosure.

In this cross-sectional view of the flexible pipe assembly 100, portions of the pipe 102 can be seen. The pipe 102 includes a first end portion 130, a second end portion 132, and a third portion 134. The third portion 134 is a bellows, and the third portion 134 extends between the first end portion 130 and the second end portion 132. The bellows 134 is configured to bend, flex, or deform to reduce a likelihood of failure in the pipe, such as cracking or breaking or any other type of failure in the pipe 102, caused by an external force, a vibration, or a relative movement the pipe 102 is exposed, which results in stresses and strains present within the pipe 102. The bellows 134 may be a traditional bellows, an accordion bellows, a torsional bellows, a straight bellows, a wrapped spiral bellows, a mesh bellows, or any other bellows as desired.

The sleeve 104, the first connection assembly 106, and the second connection assembly 108 work together to constrain the axial movement, the radial movement, and the torsional movement of the pipe 102 as discussed with respect to FIG. 1A. The sleeve 104, the first connection assembly 106, and the second connection assembly 108 allow the bellows 134 of the pipe 102 to bend, flex, or deform within a limited or constrained range when the pipe 102 is exposed to external forces, vibrations, or relative movements. For example, the pipe 102 may come under vibrational forces, external forces, or relative movements in a combination of an axial direction and a radial direction; in a combination of a radial direction and a torsional direction; in a combination of an axial direction, a radial direction, and a torsional direction; or any other combination of directions. For example, in accordance with embodiments of the present disclosure, the sleeve 104, first connection assembly 106, and second connection assembly 108 cooperate to constrain the movement of pipe 102 such that pipe 102 does not rotate due to the first connection assembly 106 and/or the second connection assembly 108. However, when the vibrational forces, external forces, or relative movements are applied to the pipe 102, the bellows 134 may bend, flex, or deform to absorb these vibrational forces, external forces, or relative movements the pipe 102 is exposed.

For example, the pipe 102 or other components of the truck may have various modes of natural structural frequency or resonant frequency. The pipe 102 or other components of the truck may have a first mode of natural structural frequency, a second mode of natural structural frequency, a third mode of natural structural frequency, and so on. It is desirable that these modes of natural structural frequencies are different than excitation frequencies that are commonly present when the truck or vehicle is in use in the operating environment of the truck or vehicle to avoid resonance, which would generally cause the pipe 102 or components of the truck to deteriorate quickly reducing their useful lifespan.

Because of the need for exhaust gas to exit the exhaust system away from the aftertreatment system, away from other vehicles or away from the ground, the outlet for the system may be a significant distance from the aftertreatment system. This requires a long section of pipe that will need additional constraints near the exit of the exhaust system. Often times, this results in constraint locations for the exhaust pipe to be connected to components of the vehicle that may have significant movement relative to each other. For example, a cab relative to a chassis of a truck or vehicle.

One cause that increases the likelihood of failure of the pipe 102 is movement between the EAS coupled to the chassis of the truck relative to the movement of the exhaust pipe coupled to the cab of the truck and vice versa. For example, when a truck turns, the chassis of the truck and the cab of the truck have a relative movement with respect to one another and may articulate or move by different amounts, which may be referred to as a "relative movement." This relative movement between the chassis and the truck may cause a relative movement between the EAS coupled to the chassis of the truck and the exhaust pipe coupled to the cab of the truck and vice versa. This relative movement between the chassis and the truck may cause a relative movement between the ends of the pipe 102.

A slider pin system, a dog bone linkage, or any number of flexible linkage mechanisms may be utilized in combination with the flexible pipe assembly 100 or separately to help allow the exhaust pipe to articulate in a manner to avoid stresses and strains caused by a difference in movement between a cab and a chassis of a vehicle or truck, this difference in movement may cause the pipe 102 to fail because the pipe 102 is connecting the EAS, which is coupled to the chassis, to the exhaust pipe, which is coupled to the cab. This difference in articulation of the EAS and the exhaust pipe is one cause of the various stresses and strains that are present in the pipe 102, which couples the exhaust pipe to the EAS, when the truck is in use. For example, the slider pin system may allow for some relative movement in an x-direction, a y-direction, and a z-direction in a xyz-coordinate system between the chassis, the cab, and the exhaust pipe of the truck. Typically, the slider pin system or similar mechanisms allow for significant relative movement in the z-direction. However, in there need to provide constraint in the x-direction and y-directions the slider pin system or similar mechanisms are overly stiff to allow for relative movement in the directions other than the z-direction. Accordingly, these mechanisms may be utilized in combination with the flexible pipe assembly 100 to increase the lifespan of the exhaust pipe of the truck.

In addition, when the sleeve 104, the first connection assembly 106, and the second connection assembly 108 are utilized together with a pipe 102 that includes a bellows 134, the pipe 102 can withstand stresses and strains, external forces, vibrational forces, and relative movements that would typically cause a normal pipe without a bellows to fail. Due to the relative movement between the EAS and the exhaust pipe as discussed above, the pipe 102 undergoes stress from movements in the truck. However, while the sleeve 104 and the first and the second connection assemblies 106, 108 constrain the axial movement, the radial movement, and the torsional movement of the pipe 102, the bellows 134 of the pipe 102 is also included to help reduce stresses and likelihood of failure when the pipe is exposed to vibrational forces, external forces, and relative movements that have a combined direction of these types of axial, radial, and torsional directions. For example, the sleeve 104, the first connection assembly 106, and the second connection assembly 108 have a high stiffness and reduce damage to the pipe 102 or the likelihood of failure of the pipe 102 when the exhaust pipe and flexible pipe assembly 100 are exposed to vibration at resonance frequencies of the exhaust assembly.

For example, if vibrational forces, external forces, and relative movements are applied to the pipe 102 and would cause the pipe 102 to move in the axial direction, the radial direction, or both in the absence of any constraint, in accordance with embodiments of the present disclosure, the bellows 134 of the pipe 102 bends, flexes, or deforms towards the sleeve 104. Also, if vibrational forces, external forces, or relative movements applied to the pipe 102 would cause the pipe 102 to move in the radial direction, the torsional direction, or both in the absence of any constraint, in accordance with the embodiments of the present disclosure, the bellows 134 of the pipe 102, bends, flexes, or deforms even more so than a pipe that does not have a bellows. Alternatively, if vibrational forces, external forces, or relative movements applied to the pipe 102 would cause the pipe 102 to move in any other combined direction in the axial direction, the radial direction, and torsional direction, the sleeve 104, the first connection assembly 106, the second connection assembly 108, and the bellows 134 of the pipe 102 all work together to reduce the likelihood of failure in the pipe 102 due to vibrational forces, external forces, and relative movements exerted on the pipe 102. The relative movement may be movements between the exhaust pipe coupled to the cab of the truck and the EAS coupled to the chassis of the truck. For example, the bellows 134 of the pipe 102 of the flexible pipe assembly 100 has a low stiffness to reduce damage to the pipe 102 or the likelihood of failure of the pipe 102 due to relative movement of the constrained ends of the pipe 102 where the pipe 102 is attached to either the aftertreatment system or an attachment mechanism up on a side of the cab where the exhaust pipe as a whole is perfectly rigid. The low stiffness reduces stresses due to relative movements in the exhaust pipe that would normally be large and cause failure in the pipe 102 or exhaust pipe if the exhaust assembly was perfectly rigid.

As discussed earlier in the present disclosure, the stresses and strains caused by the vibration of the pipe 102 are reduced because the first connection assembly 106 and the second connection assembly 108 rigidly coupled to the first and second end portions 130, 132 of the pipe 102, which increases the first mode of natural structural frequency of the pipe 102 as discussed earlier in present disclosure. Increasing the first mode of natural structural frequency reduces or prevents failure due to exposure to low vibrational excitation frequencies as discussed earlier in the present disclosure.

The first and second connection assemblies 106, 108 are rigidly coupled to the first and second end portions 130, 132 of the pipe 102 increases the first natural structural frequency mode of the pipe to be above 17 Hz, and preferably above 20 Hz, to avoid failure in the pipe 102 due to vibrational stresses that may cause the pipe 102 to vibrate at its first natural structural frequency mode. This is because low natural or resonant frequencies as the first natural structural frequency mode in components when a truck is in use generally have short useful life spans. For example, if a component in a truck has a low first natural structural frequency mode vibration it is more likely to cause the component to vibrate at its first natural structural frequency mode due to excitation frequencies that occur when the truck is in its working environment. For example, the factors as discussed above, which are not a complete list of all of the factors that can cause vibrations in the truck, are more likely to cause the component to vibrate at its first natural structural frequency mode. However, if the component's first natural structural frequency mode is increased the likelihood that external factors that cause vibrations in the component when the truck is in use will result in the component vibrating at its first structural mode is significantly decreased.

Figure 1D:
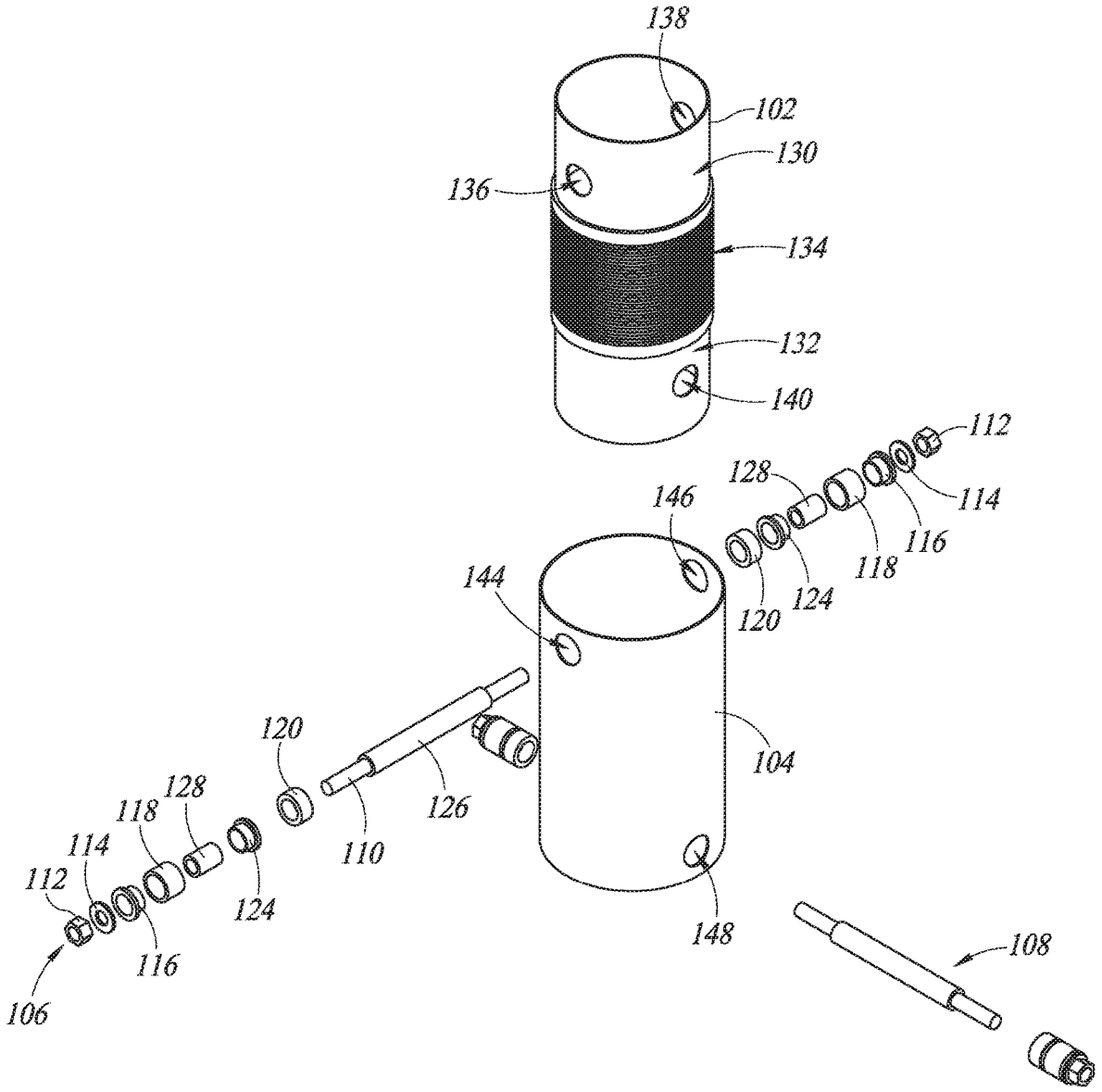
FIG. 1D is an exploded view of the embodiment of the flexible pipe assembly as illustrated in FIG. 1A.

FIG. 1D is directed to an exploded view of the flexible pipe assembly 100 in accordance with embodiments of the present disclosure that include the pipe 102, the sleeve 104, the first connection assembly 106, and the second connection assembly 108. In this exploded view, components of the first connection assembly 106 can be seen. In addition, this exploded view provides a view of how components of the flexible pipe assembly 100 correspond to each other when the flexible pipe assembly 100 is assembled. However, again, for the sake of simplicity and brevity, the details of the components of the first connection assembly 106 and the second connection assembly 108 will be discussed in greater detail with respect to FIGS. 5A-5C.

Figure 2:
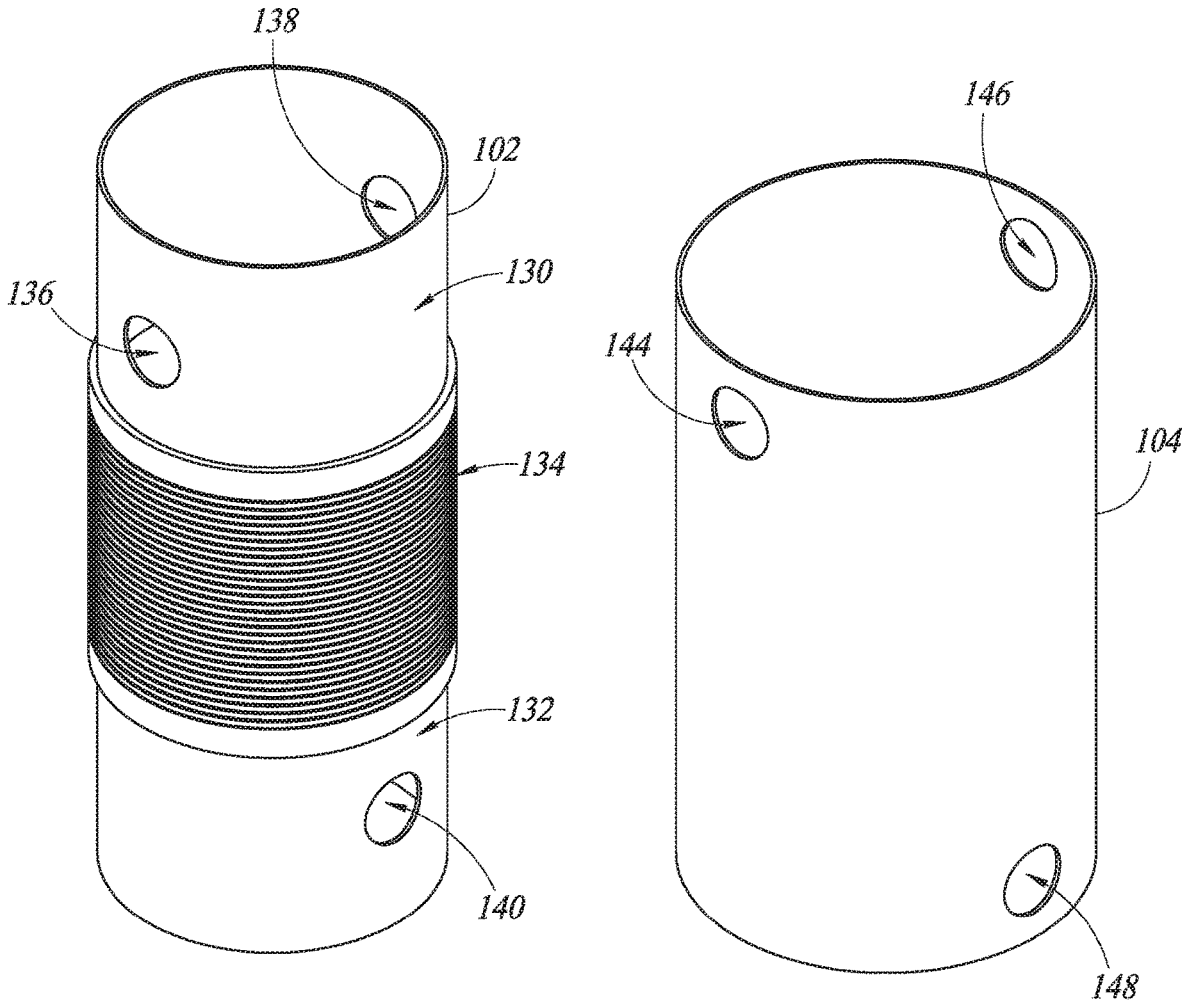
FIG. 2 is a perspective view of an embodiment of a pipe with a bellows and a perspective view of an embodiment of a sleeve of the embodiment of the flexible pipe assembly as disclosed in FIGS. 1A-1D.

FIG. 2 is directed to a perspective view of the pipe 102 and a perspective view of the sleeve 104. However, in FIG. 2, the plurality of first pipe portions 120 and the plurality of rods 126 are not shown to illustrate the holes 136, 138, 140, 142 in the pipe 102. Similarly, in FIG. 2, the plurality of pipe flanges 118 are not shown to illustrate the holes 144, 146, 148, 150 in the sleeve 104.

The pipe 102 includes a first pair of holes 136, 138. The first pair of holes 136, 138 includes a first hole 136 and a second hole 138. The first hole 136 and the second hole 138 each have a longitudinal axis that are coaxial with each other, and the first hole 136 and the second hole 138 are concentric. In other words, the first hole 136 and the second hole 138 share a longitudinal axis with each other and are aligned with each other. As discussed above, the first hole 136 and the second hole 138 of the first pair of holes 136, 138 receives and supports the first connection assembly 106.

The pipe 102 includes a second pair of holes 140, 142. The second pair of holes 140, 142 includes a third hole 140 and a fourth hole 142. The fourth hole 142 is not visible in FIG. 2, but the fourth hole 142 is visible in FIG. 3B. The third hole 140 and the fourth hole 142 each have a longitudinal axis that are coaxial with each other, and the third hole 140 and the fourth hole 142 are concentric. In other words, the third hole 140 and the fourth hole 142 share a longitudinal axis with each other and are aligned with each other. As discussed above, the third hole 140 and the fourth hole 142 of the second pair of holes 140, 142 receives and supports the second connection assembly 108. The second pair of holes 140, 142 of the pipe 102 are transverse the first pair of holes 136, 138 of the pipe 102. The shared longitudinal axis of the first pair of holes 136, 138 and the shared longitudinal axis of the second pair of holes 140, 142 may be transverse by an angle of 10 degrees, 20 degrees, 30 degrees, 45 degrees, or any angle as desired. In this disclosed embodiment the shared longitudinal axis of the first pair of holes 136, 138 is perpendicular to the shared longitudinal axis of the second pair of holes 140, 142. When the shared longitudinal axis of the first pair of holes 136, 138 is perpendicular to the shared longitudinal axis of the second pair of holes 140, 142, the first connection assembly 106 and the second connection assembly 108 will be perpendicular each other when assembled in the flexible pipe assembly 100 as discussed above. Similarly, the transverse angle between the first pair of holes 136, 138 and the second pair of holes 140, 142 will define the transverse angle between the first connection assembly 106 and the second connection assembly 108.

The sleeve 104 includes a third pair of holes 144, 146. The third pair of holes 144, 146 includes a fifth hole 144 and a sixth hole 146. The fifth hole 144 and the sixth hole 146 each have a longitudinal axis that are coaxial with each other, and the fifth hole 144 and the sixth hole 146 are concentric. In other words, the fifth hole 144 and the sixth hole 146 share a longitudinal axis with each other and are aligned with each other. As discussed above, the fifth hole 144 and the sixth hole 146 of the third pair of holes 144, 146 receives and supports the first connection assembly 106.

The sleeve 104 includes a fourth pair of holes 148, 150. The fourth pair of holes 148, 150 includes a seventh hole 148 and a eighth hole 150. The eighth hole 150 is not visible in FIG. 2, but the eighth hole 150 is visible in FIG. 4B. The seventh hole 148 and the eighth hole 150 each have a longitudinal axis that are coaxial with each other, and the seventh hole 148 and the eighth hole 150 are concentric. In other words, the seventh hole 148 and the eighth hole 150 share a longitudinal axis with each other and are aligned with each other. As discussed above, the seventh hole 148 and the eighth hole 150 of the fourth pair of holes 148, 150 receives and supports the second connection assembly 108. The fourth pair of holes 148, 150 of the sleeve 104 are transverse the third pair of holes 144, 146 of the sleeve 104. The shared longitudinal axis of the third pair of holes 144, 146 and the shared axis of the fourth pair of holes 148, 150 may be transverse by an angle of 10 degrees, 20 degrees, 30 degrees, 45 degrees, or any angle as desired. In this disclosed embodiment the shared longitudinal axis of the third pair of holes 144, 146 is perpendicular to the shared longitudinal axis of the fourth pair of holes 148, 150. When the shared longitudinal axis of the third pair of holes 144, 146 is perpendicular to the shared longitudinal axis of the fourth pair of holes 148, 150, the first connection assembly 106 and the second connection assembly 108 will be perpendicular each other when assembled in the flexible pipe assembly 100. Similarly, the transverse angle between the third pair of holes 144, 146 and the fourth pair of holes 148, 150 will define the transverse angle between the first connection assembly 106 and the second connection assembly 108.

The first pair of holes 136, 138 of the pipe 102 and the third pair of holes 144, 146 of the sleeve 104 are aligned with each other such that the first pair of holes 136, 138 of the pipe 102 and the third pair of holes 144, 146 of the sleeve 104 share a longitudinal axis. The first pair of holes 136, 138 and the third pair of holes 144, 146 are coaxial and concentric with each other. Similarly, the second pair of holes 140, 142 of the pipe 102 and the fourth pair of holes 148, 150 of the sleeve 104 are aligned with each other such that the second pair of holes 140, 142 of the pipe 102 and the fourth pair of holes 148, 150 of the sleeve 104 share a longitudinal axis. The second pair of holes 140, 142 and the fourth pair of holes 148, 150 are coaxial and concentric with each other.

Figure 3A:
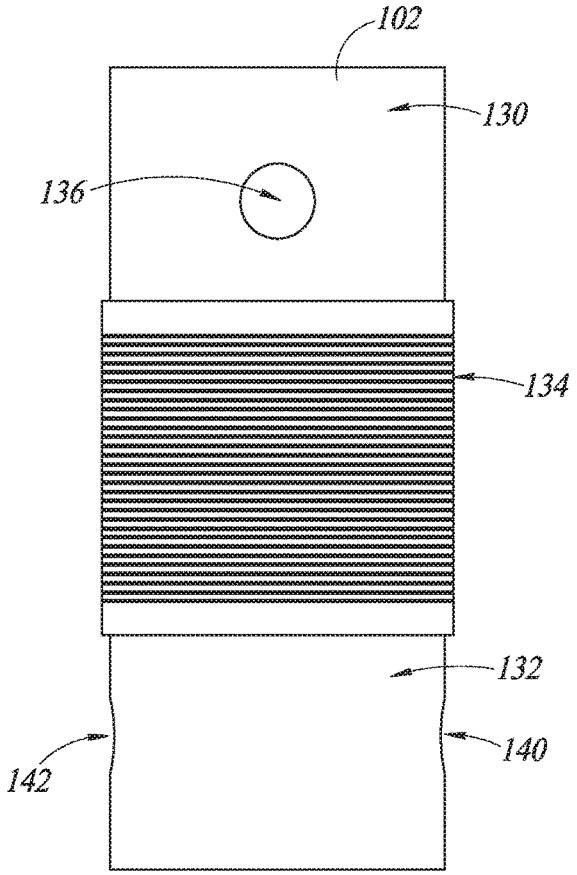
FIG. 3A is a first side view of the embodiment of the pipe with the bellows as disclosed in FIG. 2.
Figure 3B:
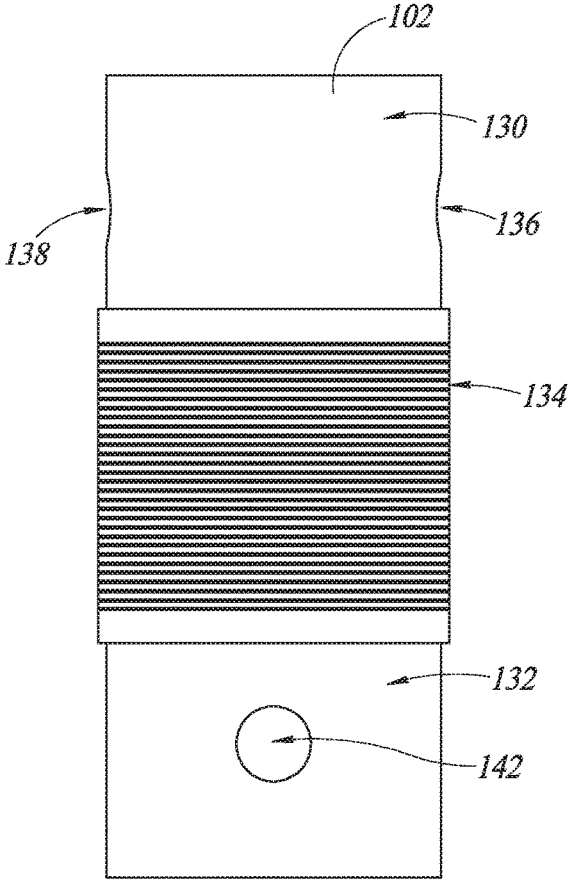
FIG. 3B is a second side view of the embodiment of the pipe with the bellows as disclosed in FIG. 2.

FIG. 3A is a first side view of the pipe 102 and FIG. 3B is a second side view of the pipe 102. The third portion 134, which is the bellows, of the pipe 102 includes a bellows portion, a first non-bellows portion coupling the third portion 134 to the first end portion 130, and a second non-bellows portion coupling the third portion 134 to the second end portion 132. For the sake of simplicity and brevity, the various holes 136, 138, 140, 142 will not be discussed again as they have been discussed in detail earlier within the present disclosure with respect to FIG. 2. In addition, in FIG. 3A, the plurality of first pipe portions 120 and the plurality of rods 126 are not shown to illustrate the holes 136, 138, 140, 142 in the pipe 102. In FIG. 3B, the fourth hole 142 of the second pair of holes 140, 142 is visible, which is unlike in FIG. 2 where the fourth hole 142 is not visible. In addition, the plurality of first pipe portions 120 and the plurality of rods 126 are not shown to illustrate the holes 136, 138, 140, 142 in the pipe 102.

Figure 4A:
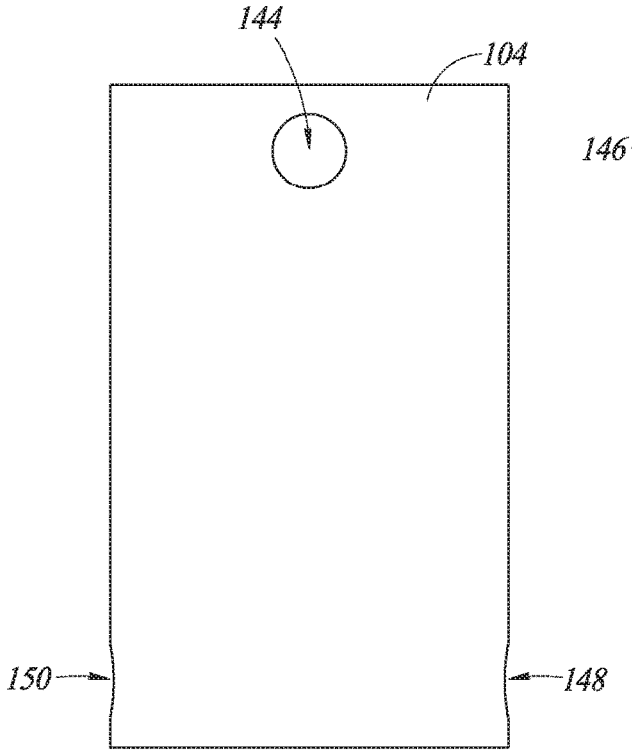
Figure 4B:
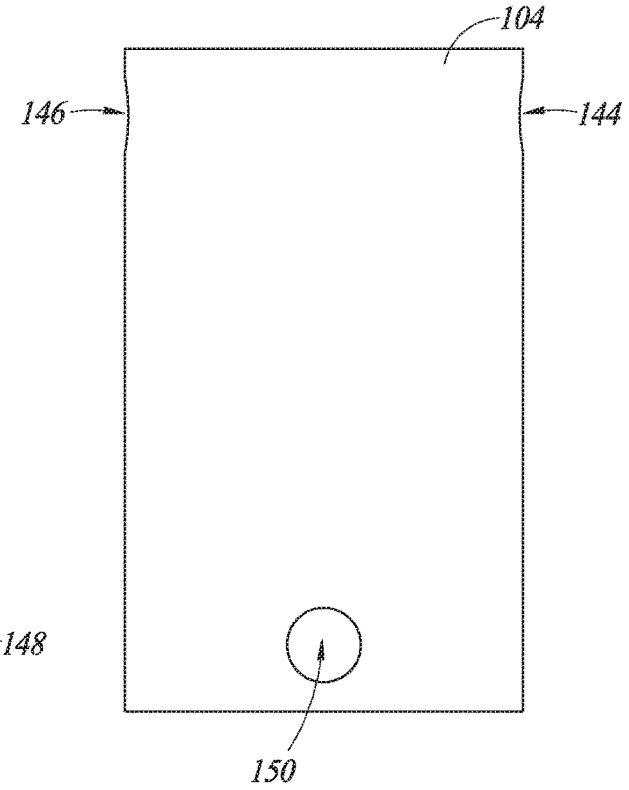

FIG. 4A is a first side view of the sleeve 104 and FIG. 4B is a second side view of the sleeve 104. The sleeve 104 includes the third pair of holes 144, 146 and the fourth pair of holes 148, 150. In FIG. 4B, the eighth hole 150 is visible, which is unlike FIG. 2 where the eighth hole 150 is not visible. In addition, in FIGS. 4A-4B, the plurality of pipe flanges 118 are not shown to illustrate the holes 144, 146, 148, 150 in the pipe 102.

Figure 5A:
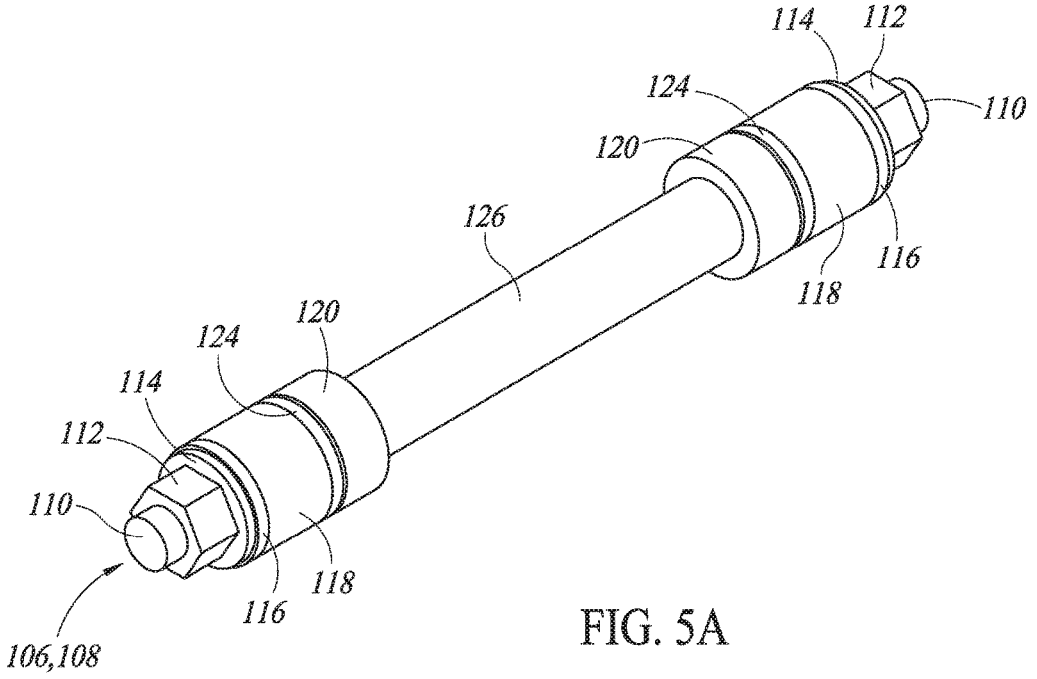
FIG. 5A is a perspective view of an embodiment of a connection assembly of the embodiment of the flexible pipe assembly as disclosed in FIGS. 1A-1D.
Figure 5B:
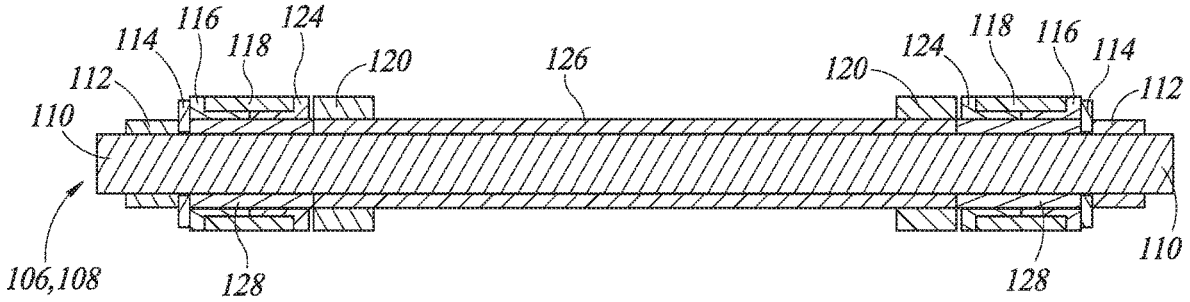
FIG. 5B is a cross-sectional side view of the embodiment of the connection assembly as disclosed in FIG. 5A.
Figure 5C:
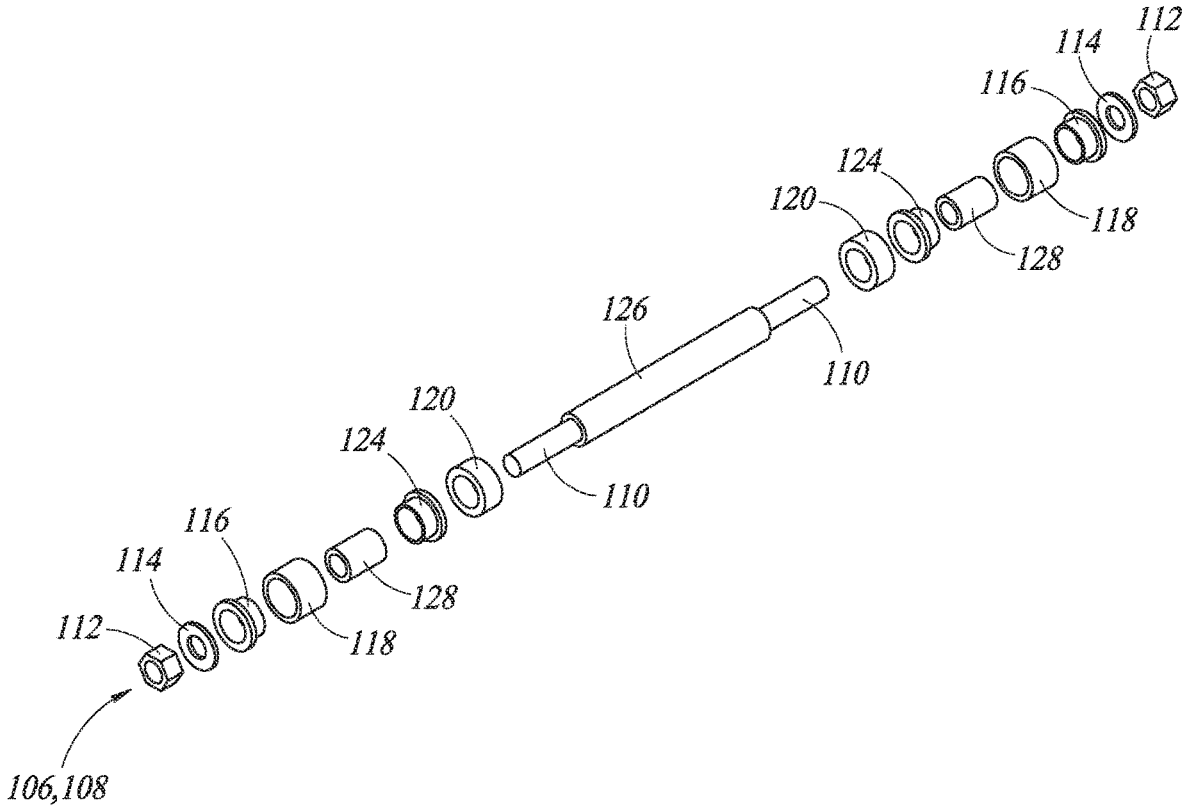
FIG. 5C is an exploded view of the embodiment of the connection assembly as disclosed in FIGS. 5A-5B.

FIGS. 5A-5C are directed to an embodiment of the first connection assembly 106 and an embodiment of the second connection assembly 108. These embodiments of the first connection assembly 106 and the second connection assembly 108 are assembled and formed to include the same or similar components. However, in other alternative embodiments of the first connection assembly 106 and the second connection assembly 108, the first and the second connection assemblies 106, 108 may have different components, may have some similar components, may be a combination of the same components assembled in a different arrangement, or may be assemblies of different components in different arrangements.

FIG. 5A is a perspective view of the first and second connection assemblies 106, 108 and FIG. 5B is a cross-sectional view taken along the centerline passing through the connection assemblies 106, 108. The connection assemblies 106, 108 include a threaded rod 110 that passes through the bore or hole in the rod 126, fasteners 112 that couple to the threaded rod, a washer 114, a second pipe portion 128, a first flanged sleeve bearing 124, and a second flanged sleeve bearing 116.

The rod 126 has an inner surface, an outer surface, and an end surface that extends between the inner surface and the outer surface. The end surface has a circular shape in this embodiment. In other alternative embodiments, the end surface may have a square shape, a rectangular shape, a diamond shape, an oval shape, or some other shape altogether. The outer surface is an exposed surface of the rod 126. The rod 126 is hollow and has a hole or bore that extends through the rod 126. The hole has a diameter that extends from a center of the rod 126 to the inner surface of the rod 126, which may be referred to as an inner diameter. The inner diameter is less than a diameter of the rod 126 that extends from the center of the rod to the outer surface of the rod, which may be referred to as an outer diameter. The rod 126 is coupled to the pipe 102 within a first respective pair of holes in the pipe 102, which can be seen in FIGS. 1A-1D. Also, although it is not visible, the inner surface of the rod 126 may be threaded to receive a threaded bolt or threaded rod 110.

A first pipe portion 120 is coupled to the first end of the rod 126. The first pipe portion 120 is also coupled to the pipe 102 and is positioned within a respective hole 136, 138, 140, 142 in the pipe 102, which can be seen in FIGS. 1A-1D. The first pipe portion 120 is welded to the first end of the rod 126 and the first pipe portion 120 is welded to the pipe 102. The first pipe portion 120 is coupled between the rod 126 and the pipe 102. The first pipe portion 120 holds the rod 126 in place, and the rod 126 extends through the pipe 102. When the first pipe portion 120 is welded to the pipe 102 and the rod 126, the welded seams seal edges of the respective hole 136, 138, 140, 142 resulting in the pipe 102 being sealed such that an exhaust gas cannot escape from the pipe 102 when the pipe is used in an exhaust system.

In an alternative embodiment, the first pipe portion 120 includes a bore or hole including an inner diameter that is substantially equal to the outer diameter of the rod 126. Because the inner diameter of the hole or bore of the first pipe portion 120 is substantially equal to the outer diameter of the rod 126, the first pipe portion 120 may be press fit onto the first end of the rod 126, which means that the inner diameter of the hole of the first pipe portion 120 may be slightly less than the outer diameter of the rod 126 to form a proper press fit between the first pipe portion 120 and the rod 126. The term "substantially" means that there may be slight variation as to the exactness of the inner diameter of the hole of the first pipe portion and the outer diameter of the rod 126 being equal. For example, the inner diameter and the outer diameter may not be perfectly equal. This term "substantially" will also apply to other similar uses of the term "substantially" in the present disclosure.

Also, in other alternative embodiments, the inner diameter of the first pipe portion may be slightly larger than or equal to the outer diameter of the rod 126 and the first pipe portion 120 may be slid onto the rod 126 and fastened to the rod 126, e.g., by a welding technique, by an adhesive, or by some other coupling technique or combination of coupling techniques.

From here on, for brevity and simplicity sake, only the arrangement of the other components making up the connection assemblies 106, 108 will be discussed with respect to a first end of the connection assemblies 106, 108. However, at a second end of the connection assemblies 106, 108, the same arrangement will result. In other alternative embodiments though, the various components may be arranged in a different manner at the first end than at the second end of the connection assemblies, or different components may be used at the first end of the connections assemblies 106, 108 than at the second end of the connection assemblies 106, 108.

A pipe flange 118 is coupled to the sleeve 104. The pipe flange 118 is configured to receive a first flanged sleeve bearing 124, a second flanged sleeve bearing 116, and a second pipe portion 128. The pipe flange 118 is coupled to the sleeve by welding the pipe flange 118 to the sleeve 104. In an alternative embodiment, the pipe flange 118 may be coupled to the sleeve 104 by an adhesive, by a press fit, or by another coupling technique or combination of coupling techniques. In another alternative embodiment, the first flanged sleeve bearing 124 may be coupled to or welded to the sleeve 104. In yet another alternative embodiment, both the pipe flange 118 and the first flanged sleeve bearing 124 may be coupled to or welded to the sleeve 104.

A second pipe portion 128 is in contact with the end surface of the rod 126 and is positioned within the pipe flange 118. In this embodiment, the second pipe portion 128 includes an inner diameter and an outer diameter that are equal to the inner diameter and the outer diameter of the rod 126. The second pipe portion 128 has a circular shape like the circular shape of the rod 126. The second pipe portion 128 is in contact with the threaded rod 110 and the inner diameter of the second pipe portion 128 is substantially equal to the outer diameter of the threaded rod 110. In this embodiment, the inner surface of the second pipe 128 is smooth. In an alternative embodiment, the inner surface of the second pipe portion 128 may be threaded to receive the threads of the threaded rod 110.

However, in other alternative embodiments, the inner diameter and the outer diameter of the second pipe portion 128 may be greater than or less than the inner diameter and outer diameter of the rod 126. Also, in other alternative embodiments, the second pipe portion 128 will have a cross sectional shape that corresponds to the cross-sectional shape of the rod 126. For example, if the rod 126 has a cross-sectional shape of a square, then the second pipe portion 128 will also have a corresponding square cross-sectional shape. This applies for any cross-sectional shape as desired.

The second pipe portion 128 is in contact with a first flanged sleeve bearing 124 and a second flanged sleeve bearing 116. The first flanged sleeve bearing 124 may be slid onto, may be press fit onto, or may be welded onto the second pipe portion 128. The first flanged sleeve bearing 124 includes an inner diameter, a first outer diameter, and a second outer diameter. The second outer diameter is larger than the first outer diameter, and the second outer diameter corresponds to a flange portion of the first flanged sleeve bearing 124. The flange portion of the first flanged sleeve bearing 124 is positioned adjacent to the first pipe portion 120. The flange portion of the first flanged sleeve bearing 124 is spaced from the first pipe portion 120 in this embodiment of the connection assemblies 106, 108. In this embodiment, the second outer diameter of the first flanged sleeve bearing 124 is equal to the outer diameter of the first pipe portion 120.

However, in other alternative embodiments, the flanged portion of the first flanged sleeve bearing 124 may be in contact with the first pipe portion 120. Also, in other alternative embodiments, the outer diameter of the flanged sleeve bearing 124 and the outer diameter of the first pipe portion 120 may be different.

In this embodiment, the first flanged sleeve bearing 124 may be press fit onto the second pipe portion 128 or may be welded to the second pipe portion 128. In addition, the pipe flange 118 coupled to the sleeve 104 is aligned with and surrounds the first flanged sleeve bearing 124.

The second flanged sleeve bearing 116 is adjacent to and is in contact with an end of the first flanged sleeve bearing 124. The second flanged sleeve bearing 116 in this embodiment is the same as the first flanged sleeve bearing 124. However, in other alternative embodiments, the first and the second flanged sleeve bearings 124, 116 may be different. In this embodiment, the first and second flanged sleeve bearings 124, 116 may be high temperature dry running flanged sleeve bearings that are made of porous bronze graphite material, a material plated with the porous bronze graphite material, or a material that includes a percentage of the porous bronze graphite material. A flanged portion of the second flanged sleeve bearing 116 is facing away from the flanged portion of the first flanged sleeve bearing 124. The second flanged sleeve bearing 116 is in a reversed or mirrored orientation of the first flanged sleeve bearing 124. Similar to the first flanged sleeve bearing 124, the second flanged sleeve bearing 116 includes an inner diameter, a first outer diameter, and a second outer diameter, which are equal to, respectively, the inner diameter, the first outer diameter, and the second outer diameter of the first flanged sleeve bearing 124. The second flanged sleeve bearing 116 may be slid onto, may be press fit onto, or may be welded to the second pipe portion 128.

The pipe flange 118 is in contact with the first flanged sleeve bearing 124 and the second flanged sleeve bearing 116, the pipe flange surrounds portions of the first flanged sleeve bearing 124 and the second flanged sleeve bearing 116 that have the first outer diameter that is less than the second outer diameter of the first and the second flanged sleeve bearings 116, 124. The pipe flange 118 has an inner diameter that is substantially the same as the first outer diameter of the first and the second flanged sleeve bearings 124, 116. The first flanged sleeve bearing 124, the second flanged sleeve bearing 116, and second pipe portion 128 may be press fit into the pipe flange 118. In an alternative embodiment, the first flanged sleeve bearing 124 may be welded to the second pipe portion 128. In another alternative embodiment, the second flanged sleeve bearing 116 may be welded to the second pipe portion 128.

In this embodiment, when the second pipe portion 128, the first flanged sleeve bearing 124, and the second flanged sleeve bearing 116 are placed within the pipe flange 118, the press fit, which may be a tolerance fit, is tight enough resulting in the second pipe portion 128, the first flanged sleeve bearing 124, and the second flanged sleeve bearing 116 being held in place. However, the tolerance fit is loose enough to allow the second pipe portion 128, the first flanged sleeve bearing 124, and the second sleeve bearing 116 to be removed if desired with a sufficient amount of force. In an alternative embodiment, the tolerance fit may be tighter resulting in a press fit so the second pipe portion 128, the first flanged sleeve bearing 124, and the second flanged sleeve bearing 116 are held strongly in place and may not be easily removed. In another alternative embodiment, the first flanged sleeve bearing 124, the second flanged sleeve bearing 116, and the second pipe portion 128 may be held within the pipe flange 118 with an adhesive material or some other coupling technique or combination of coupling techniques.

A washer 114 is then placed on the first end of the threaded rod 110 that is left exposed after the threaded rod 110 has been positioned within the holes of the second pipe portion 128 and the rod 126. A fastener 112, e.g., a nut, is then threaded onto the thread of the threaded rod 110 and holds the washer 114 between the fastener 112, the second pipe portion 128, and the second flanged sleeve bearing 116. In this embodiment, the washer 114 is in contact with the flanged portion of the second flanged sleeve bearing 116 and the second pipe portion 128. However, in an alternative embodiment, the washer 114 may be in contact with only one of the second flanged sleeve bearing 116 or the second pipe portion 128.

The threaded rod 110, which may be a threaded bolt, extends through the second pipe portion 128 and the rod 126. Although the thread of the threaded rod 110 is not visible, the thread of the threaded rod 110 extends along and on a surface of the threaded rod 110 for a length of the threaded rod 110. In various embodiments of the threaded rod 110, the length that the thread extends along the threaded rod 110 may be the entire length of the threaded rod 110 or the length of the thread may be only a portion of the length of the threaded rod 110.

Also, in this embodiment as disclosed in FIGS. 5A-5C, the threaded rod 110 extends from a first end of the rod 126 to a second end of the rod 126 through the hole in the rod 126. A first end of the threaded rod 110 extends outward from the first end of the rod 126 and is exposed. A second end of the threaded rod 110 extends outward from the second end of the rod 126 and is exposed. The second end of the threaded rod 110 is facing away from the first end of the threaded rod 110. The threaded rod 110 is free floating within the rod 126 and allows the rod 126 of the pipe 102 to slide along the threaded rod 110. The first fastener, e.g., a nut 112, is coupled to the first end of the threaded rod 110 and the second fastener, e.g., a nut 112, is coupled to the second end of the threaded rod 110. The threaded rod 110 and the two fasteners 112 are configured to hold the other various components of the connection assemblies 106, 108 on the rod 126, which have been positioned as discussed above. Because the first flanged sleeve bearing 124 and the second flanged sleeve bearing 116 are held in place by the fastener, the flange portions of the first flange sleeve bearing 124 and the second flanged sleeve bearing 116 lock the pipe flange 118 in place. Because the pipe flange 118 is locked in place and is coupled to the sleeve 104, the sleeve 104 is also locked in place by the flange portions of the first flange sleeve bearing 124 and the second flanged sleeve bearing 116.

The configuration of the various components as discussed above may be replicated to assemble the first connection assembly 106 and the second connection assembly 108 as desired.

FIG. 5C is an exploded view of the first connection assembly 106 and the second connection assembly 108, the first pipe portion 120, and the rod 126. The first pipe portion 120 is coupled to the rod 126 and the pipe 102, which can be seen in FIGS. 1A-1D, and the pipe flange 118 is coupled to the sleeve 104, which can be seen in FIGS. 1A-1D. The same applies to FIG. 5C as discussed above in detail with respect to FIGS. 5A and 5B in regards to the first and the second connection assemblies 106, 108, the first pipe portion 120, the rod 126, and the pipe flange 118.

Figure 6:
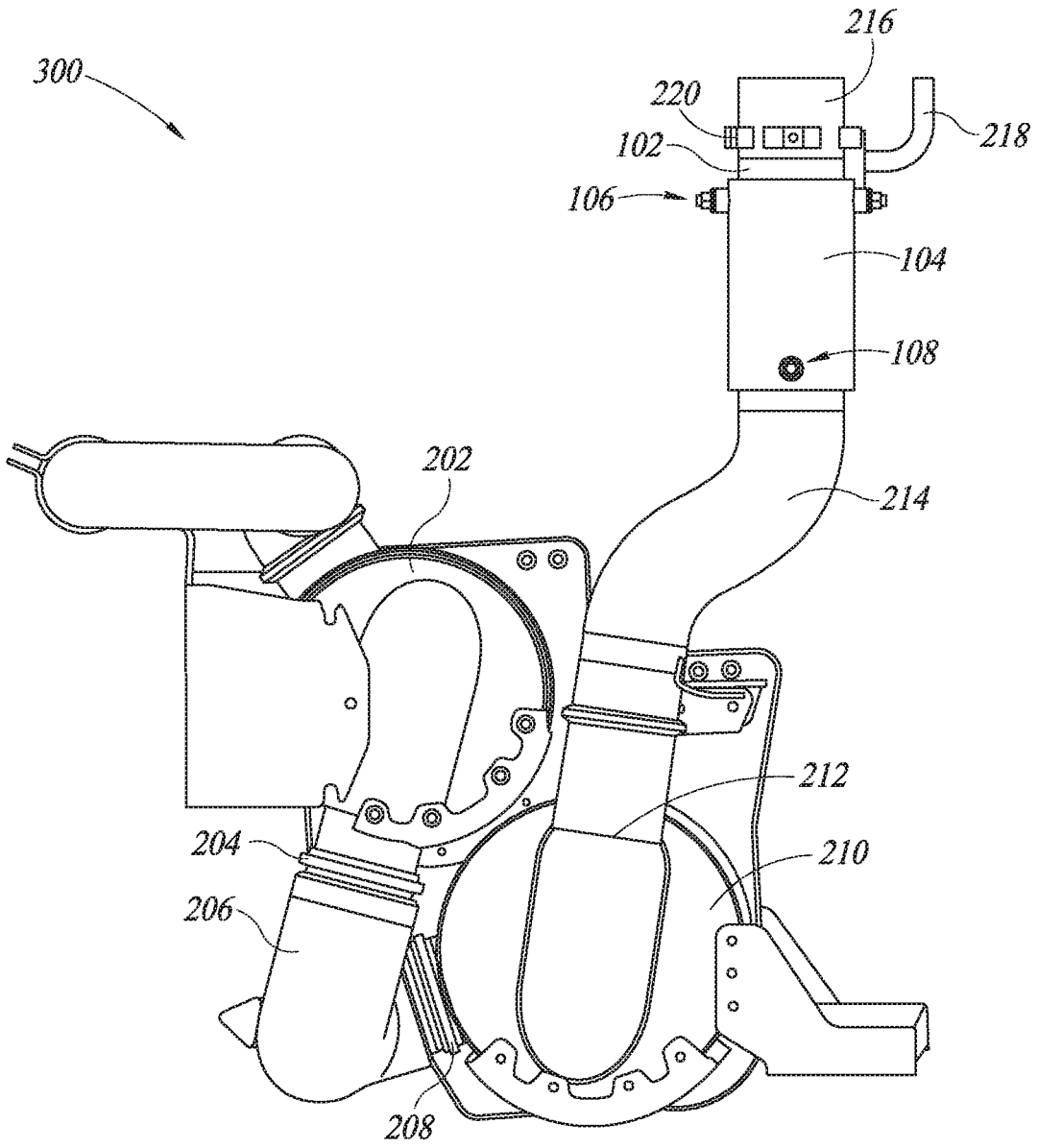
FIG. 6 is a side view of an embodiment of an engine with an exhaust aftertreatment system (EAS) and an embodiment of the flexible pipe assembly.

FIG. 6 is directed to an engine 300 including the flexible pipe assembly 100. The flexible pipe assembly 100 can be seen in the upper right hand corner of FIG. 6. The flexible pipe assembly 100 includes the pipe 102, the sleeve 104, the first connection assembly 106, the second connection assembly 108, the plurality of rods 126, and the plurality of first pipe portions 120.

The engine 300 includes a combustion chamber 202 that includes an outlet 204 that is coupled to a first end of a first pipe 206. A second end of the first pipe 206 is coupled to an inlet 208 of an exhaust aftertreatment system (EAS) 210. The EAS 210 includes an outlet 212 that is coupled to a first end of a second pipe 214. The second pipe 214 is bent and has a second end coupled to the second end portion 132 of the pipe 102 of the flexible pipe assembly 100. In the illustrated embodiment, the bend, flex, or deformation in the second pipe 214 may be an S-bend. The pipe 102 of the flexible pipe assembly and the second pipe 214 may be coupled together by welding, bolting, press-fitting, or utilizing any other coupling technique or combination of coupling techniques. The first end portion 130 of the pipe 102 is coupled to an exhaust pipe 216. The exhaust pipe may include mounting components 218, 220 to hold the exhaust pipe 216 adjacent to a cab of a truck and to maintain the positioning of the exhaust pipe 216 when the truck is in use.

When a flexible pipe assembly 100 in accordance with the present embodiments is connected to an outlet of an EAS with a pipe that is provided with bends, such as the S-bend pipe in FIG. 6, the pipe with the bend is less likely to fail. When the S-bend pipe, as shown in FIG. 6, is coupled to the pipe 102 of the flexible pipe assembly 100, the stress that occurs in the S-bend pipe is significantly reduced because the flexible pipe assembly 100 has a bellows making it more compliant to external stresses such as vibrational stresses, resonance stresses, frequency stresses, and any other stress and strains that an exhaust system may be exposed when in use in a truck. Thus, allowing the end attached to the EAS and the other end of the pipe to move with its attachment to the cab. For example, the bellows 134 of the pipe 102 can flex, bend, deform and move in response to relative movements between the chassis and the cab of the truck.

While an S-bend pipe is shown in FIG. 6, other types of pipe may be utilized for routing exhaust through the EAS to the exhaust pipe 216. For example, a straight pipe, a C-bend pipe, or any other type of pipe for routing exhaust to the exhaust pipe 216 from the outlet 212 similar to the S-bend pipe 214.

The flexible pipe assembly 100 does not introduce any new vibrational failure modes because the configuration of the sleeve 104 and connection assemblies 106, 108 provide high stiffness constraints to all flexible degrees of freedom provided by the bellows 134 that are not needed for the compliance that allows for relative movement between the EAS and the cab. These added constraints allow the system to maintain having all natural structural frequency modes at a higher stiffness than are likely to be excited at resonance with excitation frequencies present in the operating environment of the truck or vehicle.

The various embodiments described above can be combined to provide further embodiments. Aspects of the embodiments can be modified, if necessary to employ concepts of the various patents, applications and publications to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An assembly, comprising:

a sleeve including a first pair of holes and a second pair of holes;

a pipe surrounded by the sleeve, the pipe including:

a first end portion, a second end portion, and a third portion between the first end portion and the second end portion;

the first end portion including a third pair of holes, the third pair of holes aligned with the first pair of holes; and the second end portion including a fourth pair of holes, the fourth pair of holes aligned with the second pair of holes;

a first connection assembly is received in the first pair of holes and the third pair of holes and couples the sleeve to the first end portion of the pipe in a manner that constrains radial translational motion of the first end portion of the pipe relative to the sleeve, constrains axial translational motion of the first end portion of the pipe relative to the sleeve along a longitudinal axis of the sleeve, and constrains rotational motion of the first end portion of the pipe relative to the sleeve about the longitudinal axis of the sleeve, while enabling rotational motion of the first end portion of the pipe relative to the sleeve about a first longitudinal axis of the first connection assembly; and a second connection assembly is received in the second pair of holes and the fourth pair of holes and couples the sleeve to the second end portion of the pipe in a manner that constrains radial translational motion of the second end portion of the pipe relative to the sleeve, constrains axial translational motion of the second end portion of the pipe relative to the sleeve along the longitudinal axis of the sleeve, and constrains rotational motion of the second end portion of the pipe relative to the sleeve about the longitudinal axis of the sleeve, while enabling rotational motion of the second end portion of the pipe relative to the sleeve about a second longitudinal axis of the second connection assembly.

2. The assembly of claim 1, wherein the third portion of the pipe is a bellows and is configured to deform, in operation, when the pipe is exposed to a relative movement.

3. The assembly of claim 1, further comprising:

a first rod having an end, an outer surface, a hole that passes through the first rod, and an inner surface, the rod has an outer diameter and an inner diameter, and the hole has the inner diameter; and a first pipe portion coupled to the outer surface of the first rod, the first pipe portion is adjacent to the end of the rod, the first pipe portion has a hole with a diameter, the diameter of the hole of the first pipe portion is substantially equal to the outer diameter of the first rod;

wherein the first connection assembly further comprises:

a second pipe portion in contact with the end of the rod, the second pipe portion has a hole with an inner diameter and an outer surface with an outer diameter, the inner diameter of the hole of the second pipe portion is substantially equal to the inner diameter of the rod;

a first flanged sleeve bearing having a hole with a diameter, the first flanged sleeve bearing surrounds the second pipe and the diameter of the hole of the first flanged sleeve bearing is substantially equal to the outer diameter of the second pipe, the first flanged sleeve bearing is in contact with the outer surface of the second pipe portion;

a second flanged sleeve bearing having a hole with a diameter, the second flanged sleeve bearing surrounds the second pipe portion and the diameter of the hole of the second flanged sleeve bearing is substantially equal to the outer diameter of the second pipe portion, the second flanged sleeve bearing is in contact with the outer surface of the second pipe portion;

a first pipe flange in contact with the first flanged sleeve bearing and the second flanged sleeve bearing, the first pipe flange surrounds a first portion of the first flanged sleeve bearing and a second portion of the second flanged sleeve bearing;

a first washer in contact with a surface of the second flanged sleeve bearing;

a first threaded rod passes through the hole in the first rod and the hole in the second pipe portion and has an end; and a first fastener is coupled to the end of the first threaded rod.

4. The assembly of claim 3, wherein further comprising:

a second rod having an end, an outer surface, a hole that passes through the second rod, and an inner surface, the second rod has an outer diameter and an inner diameter, and the hole has the inner diameter; and a third pipe portion in contact with the outer surface of the second rod, the third pipe portion is adjacent to the end of the second rod, the third pipe portion has a hole with a diameter, the diameter of the hole of the third pipe portion is substantially equal to the outer diameter of the second rod;

wherein the second connection assembly further comprises:

a fourth pipe portion in contact with the end of the rod, the fourth pipe portion has a hole with an inner diameter and an outer surface with an outer diameter, the inner diameter of the hole of the fourth pipe portion is substantially equal to the inner diameter of the second rod;

a third flanged sleeve bearing having a hole with a diameter, the third flanged sleeve bearing surrounds the third pipe portion and the diameter of the hole of the third flanged sleeve bearing is substantially equal to the outer diameter of the third pipe portion, the third flanged sleeve bearing is in contact with the outer surface of the fourth pipe portion;

a fourth flanged sleeve bearing having a hole with a diameter, the fourth flanged sleeve bearing surrounds the fourth pipe portion and the diameter of the hole of the fourth flanged sleeve bearing is substantially equal to the outer diameter of the fourth pipe portion, the fourth flanged sleeve bearing is in contact with the outer surface of the fourth pipe portion;

a second pipe flange in contact with third flanged sleeve bearing and the fourth flanged sleeve bearing, the second pipe flange surrounds a third portion of the third flanged sleeve bearing and a fourth portion of the fourth flanged sleeve bearing;

a second washer in contact with a surface of the second flanged sleeve bearing;

a second threaded rod passes through the hole in the second rod and the hole in the fourth pipe portion and has an end; and a second fastener is coupled to the end of the second threaded rod.

5. The assembly of claim 1, wherein the second connection assembly is transverse the first connection assembly and passes through the second pair of holes in the sleeve and the fourth pair of holes of the pipe.

6. The assembly of claim 1, wherein the first connection assembly passes through the first pair of holes of the sleeve and the third pair of holes of the pipe.

7. The assembly of claim 1, wherein the sleeve has a first height and the pipe has a second height that is greater than the first height of the sleeve.

8. The assembly of claim 1, wherein the first pair of holes of the sleeve is transverse the second pair of holes of the sleeve.

9. The assembly of claim 1, wherein the third pair of holes of the pipe is transverse the fourth pair of holes of the pipe.

10. A truck, comprising:

an engine;

an exhaust aftertreatment system coupled to the engine, the exhaust aftertreatment system includes an outlet;

an outlet pipe including an inlet end and an outlet end, the inlet end coupled to the outlet of the exhaust aftertreatment system;

a flexible pipe assembly coupled to the outlet end of the outlet pipe, the flexible pipe assembly including:

a sleeve including a first pair of holes and a second pair of holes;

a pipe surrounded by the sleeve, the pipe including a third pair of holes and a fourth pair of holes;

a first connection assembly extends through the first pair of holes of the sleeve and the third pair of holes of the pipe; and a second connection assembly extends through the second pair of holes of the sleeve and the fourth pair of holes of the pipe;

an exhaust pipe coupled to the flexible pipe assembly and an outer surface of the truck.

11. The truck of claim 10, wherein the sleeve and the pipe of the flexible pipe assembly are axially, radially, and torsionally constrained by the first connection assembly and the second connection assembly.

12. The truck of claim 10, wherein the flexible pipe assembly is configured to resist failure due to vibrations, external forces, and relative movements when the truck is in use.

13. The truck of claim 10, wherein the pipe includes a first end portion, a second end portion, and a third bellows portion coupling the first end portion to the second end portion.

14. The truck of claim 10, wherein an inlet end of the sleeve of the flexible pipe assembly is coupled to the outlet end of the outlet pipe and an outlet end of the sleeve is coupled to the exhaust pipe.

15. The truck of claim 10, further comprising:

a cab; and a mounting component coupled to the cab, the mounting component surrounds the exhaust pipe and positions the exhaust pipe adjacent to the cab.

16. The truck of claim 10, wherein the second connection assembly is transverse the first connection assembly.

17. The truck of claim 10, wherein the flexible pipe assembly further comprising:

a first and second rod each having an end, an outer surface, a hole that passes through the first and second rod, and an inner surface, the first and second rods have an outer diameter and an inner diameter, the holes of the first and second rod have the corresponding inner diameter of the first and second rod, respectively; and a first and second pipe portion each is in contact with the outer surface of a corresponding one of the first and second rod, the first and second pipe portions are adjacent to a corresponding one of the ends of the first and second rod, the first and second pipe portion has each have a hole with a diameter, the diameters of the holes of the first and second pipe portion are substantially equal to the outer diameter of the first and second rod, respectively;

wherein the first connection assembly and the second connection assembly further comprises:

a third pipe portion in contact with the end of a corresponding one of the fed first and second rods, the third pipe portion has a hole with an inner diameter and an outer surface with an outer diameter, the inner diameter of the hole of the third pipe portion is substantially equal to the inner diameter of a corresponding one of the first and second rods;

a first flanged sleeve bearing having a hole with a diameter, the first flanged sleeve bearing surrounds the third pipe portion and the diameter of the hole of the first flanged sleeve bearing is substantially equal to the outer diameter of the third pipe portion, the first flanged sleeve bearing is in contact with the outer surface of the third pipe portion;

a second flanged sleeve bearing having a hole with a diameter, the second flanged sleeve bearing surrounds the third pipe portion and the diameter of the hole of the second flanged sleeve bearing is substantially equal to the outer diameter of the third pipe portion, the second flanged sleeve bearing is in contact with the outer surface of the third pipe portion;

a pipe flange in contact with the first flanged sleeve bearing and the second flanged sleeve bearing, the pipe flange surrounds a first portion of the first flanged sleeve bearing and a second portion of the second flanged sleeve bearing;

a washer in contact with a surface of the second flanged sleeve bearing;

a threaded rod passes through the hole in the rod and the hole in the second pipe portion and has an end; and a fastener is coupled to the end of the threaded rod.

18. An assembly, comprising:

an inner pipe including:

a first end portion including a first hole and a second hole, the first hole and the second hole are coaxial and each have a first longitudinal axis;

a second end portion including a third hole and a fourth hole, the third hole and the fourth hole are coaxial and each have a second longitudinal axis, the second longitudinal axis is transverse the first longitudinal axis; and a third portion coupling the first end portion to the second end portion, the third portion having a bellows structure;

an outer sleeve surrounding the inner pipe, the outer sleeve including:

a fifth hole and a sixth hole coaxially aligned with the first hole and the second hole; and a seventh hole and an eighth hole coaxially aligned with the third hole and the fourth hole;

a first connection assembly extending through the first hole, the second hole, the fifth hole, and the sixth hole; and a second connection assembly extending through the third hole, the fourth hole, the seventh hole, and the eighth hole.

19. The assembly of claim 18, wherein the first hole has a first diameter and the second hole has a second diameter, the first diameter is equal to the second diameter.

20. The assembly of claim 19, wherein the third hole has a third diameter and the fourth hole has a fourth diameter, the third diameter is equal to the second diameter.

* * * * *